US006317897B1

(12) United States Patent
Chiang

(10) Patent No.: US 6,317,897 B1
(45) Date of Patent: Nov. 20, 2001

(54) SWIMMING GOGGLES

(76) Inventor: Herman Chiang, 2F, No 634-9 Ching-Ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 09/497,286

(22) Filed: Feb. 2, 2000

(51) Int. Cl.[7] ..... A61F 9/02
(52) U.S. Cl. ..... 2/428
(58) Field of Search ..... 2/426, 428, 430, 2/440, 441–444, 446, 448, 450, 452

(56) References Cited

U.S. PATENT DOCUMENTS 5,515,551 * 5/1996 Yashiro ..... 2/428
5,802,620 * 9/1998 Chiang ..... 2/428
5,894,606 * 4/1999 Chiang ..... 2/440
5,950,248 * 9/1999 Kawashima et al. ..... 2/441
6,023,791 * 2/2000 Chiang ..... 2/441
6,119,277 * 9/2000 Chiang ..... 2/428
6,151,720 * 11/2000 Chiang ..... 2/428

* cited by examiner

*Primary Examiner*—John J. Calvert
*Assistant Examiner*—Katherine Moran
(74) *Attorney, Agent, or Firm*—Pro-Techtor International Services

(57) ABSTRACT

The invention provides a new type of swimming goggles, characterized in that: a binding frame is used for assembling the main lens frames. The binding frame includes left and right frame units and a nose bridge that combines the left and right frame units. On the left and right frame units near the nose bridge is at least one clasp unit. On the main frame unit corresponding to the clasp unit is a clasp piece. On one side of the left and right frame units away from the nose bridge is an assembling device, thus with the coordinative assembly of the clasp unit, the clasp piece and the assembling device, the main frame unit can be securely fastened onto the binding frame.

7 Claims, 5 Drawing Sheets

SWIMMING GOGGLES

FIELD OF THE INVENTION

The subject invention relates to a type of swimming goggles, particularly to one with a nose bridge involving flexible frames and clasp pieces to combine left and right lens frames.

BACKGROUND OF THE INVENTION

There are different ways to join the lens frames of swimming goggles, which can be grouped into two categories: one is a monobloc lens frame form, protective pads and the nose bridge, the other involves fastening the left and right lens frames using a nose bridge. The monobloc type of nose bridge is a simple type that does not allow adjustment. This nose bridge specification will suit the general consumer public. The fastening type allows multiple-step adjustment. The consumer can make proper adjustment to suit the span between the user's eyes. Both types have their market share, and their respective advantages and disadvantages in production. Basically, therefore, the development and improvement of the monobloc type and the fastening type are designed separately.

However, the monobloc type of swimming goggles that are easy to use without the need for adjustment has become the mainstream in appeal and design. The conventional monobloc type of swimming goggles is generally made from hard resin (polycarbonate resin), in which entire frame body is rigid without flexibility, so it only suits users with a specific face shape. As a result, another conventional design has been developed which uses soft resin to shape the lens frames, nose bridge and protective pads as one monobloc. The nose bridge serves the concurrent purposes of joining the two frames and providing proper flexibility and avoiding deformation of the frame body due to the lens accommodation. This lens type cannot withstand the pulling force of the headband, and special consideration must be paid to the construction of the swimming goggles, such as: reinforced strength design for the nose bridge, or reinforced strength against frame body deformation, so that the frame body will not be deformed.

BRIEF DESCRIPTION OF THE INVENTION

The objective of the subject invention is to provide a new swimming goggle construction with an innovative design that can be conveniently assembled and comfortably worn by the user. Said swimming goggles provide twin frames made from a flexible material to joint the frames. Thus, the twin frames can be separately considered in terms of design and suitable material selection. Considerations can be taken to require the nose bridge to be equipped with adequate tensile strength, to provide a monobloc type exterior configuration and fastening assembly style.

The subject invention is characterized in that: the swimming goggles have a binding frame that is used for the assembly of the main lens frame. The binding frame includes the left and right frame units and a nose bridge linking the left and right frame units. On the left and right frame units near the nose bridge is a clasp unit. On the main frame unit corresponding to the clasp unit is a clasp piece, thereby secures the main frame unit to the binding frame.

As mentioned in the above characteristics, the clasp unit has clasp grooves on the left and right frame units corresponding to the nose bridge. The clasp piece is formed as a post on the main frame unit.

Another characteristic of the subject invention is that, on one side of the left and right frame units, away from the nose bridge, and between the main frame units is an assembling device. The assembling device includes assembling grooves on the left and right frame units. A check unit on the main frame unit corresponds to the assembling groove with a joining unit in contact with the check unit. On the joining unit are headband positioning grooves to enable assembling the main frame unit with the left and right frame units.

The assembling groove is an opening facing from outside to the inside of the left and right frames. The check unit is a clasp piece formed on the main frame unit. The joining unit refers to a first clasp arm and a second clasp arm formed on one side of a plate body and in contact with the clasp piece. On the plate surface are several grooves for the positioning of the headband.

DETAILED DESCRIPTION OF PREFERRED EMBODIMENT

Protective pads 106, 106' are attached to the lenses 110, 110' to provide greater comfort and better contact with the user's face.

Figure 1:
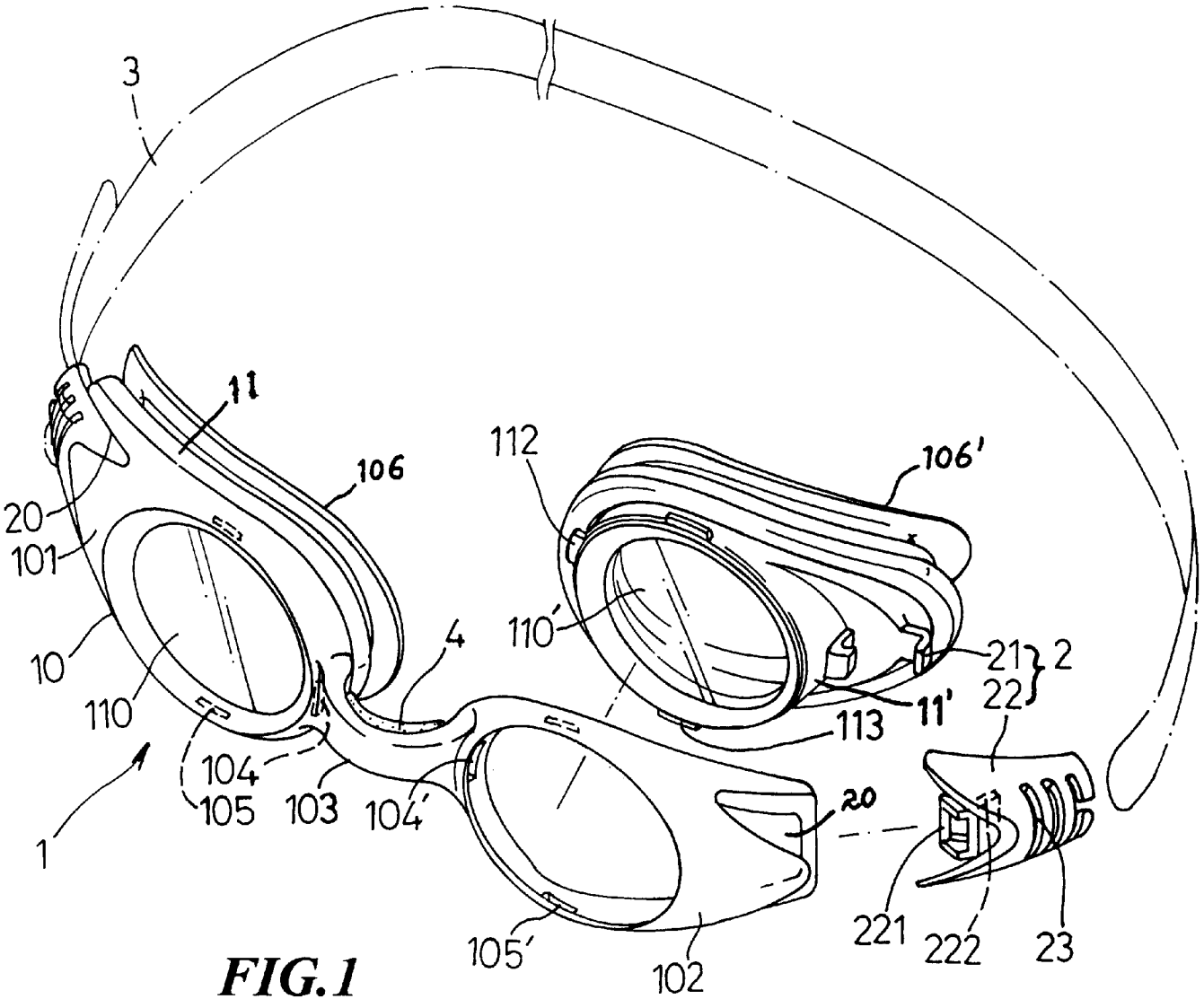
FIG. 1 is a perspective, disassembled view of the subject swimming goggle invention.
Figure 2:
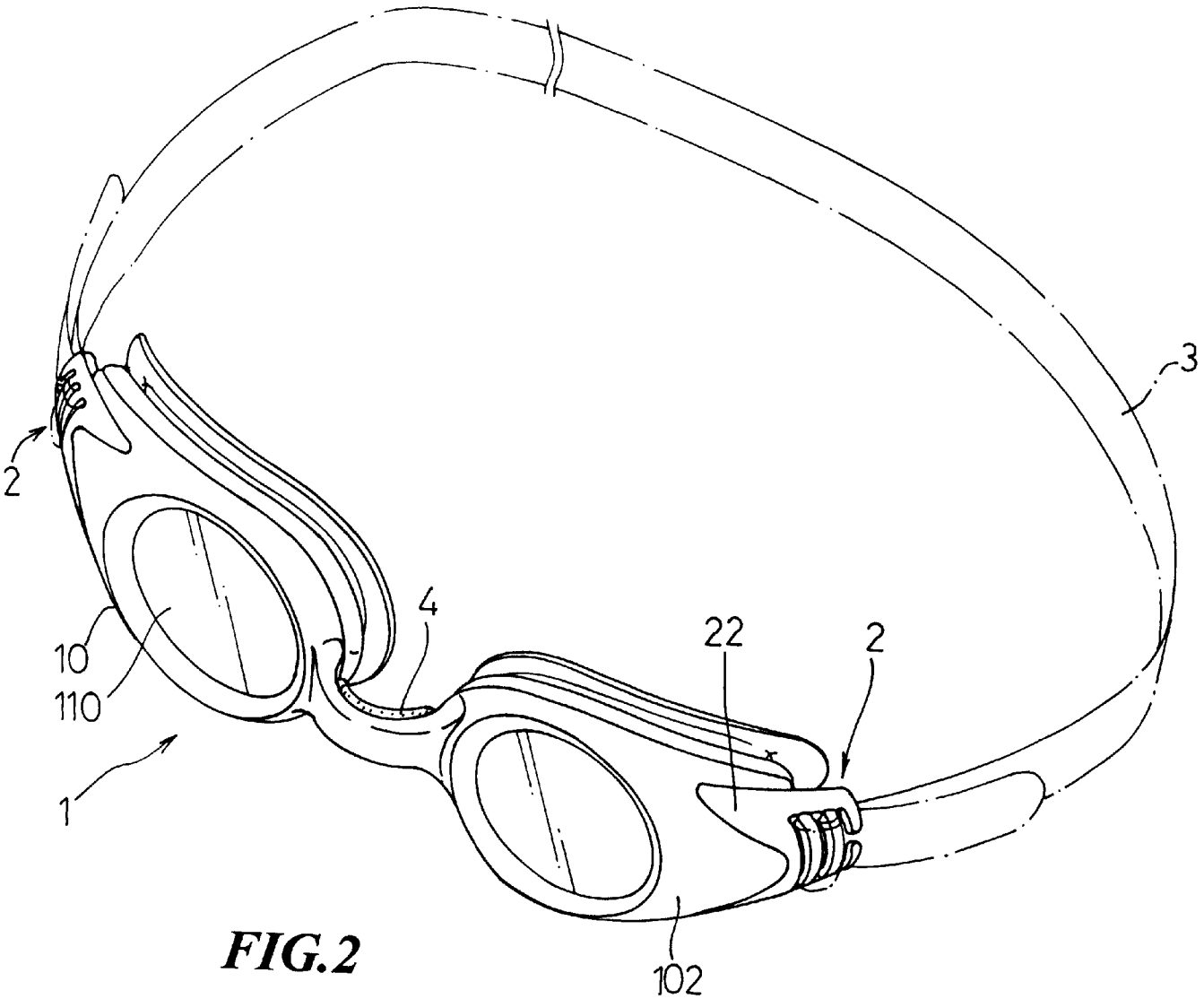
FIG. 2 is a perspective, assembled view of the subject swimming goggle invention.

Please refer to FIGS. 1 and 2, the subject swimming goggles invention 1 is comprised of a binding frame 10, two lens frames 11 and 11', an assembling device 2, and a headband device 3. The binding frame 10 is made of a flexible material involving a left and a right frame unit 101 and 102, serving to accommodate the lens frames 11 and 11' in a way that the lens 110 and 110' accommodate the lens frames 11 and 11' match the left/right frame units 101 and 102. The left and right frame units 101 and 102 are joined by a nose bridge 103. On the nose bridge 103 is a foam sponge 4 to provide comfortable contact with the user's nose ridge. Near the nose bridge on the left and right frame units 101 and 102 are three clasping units, respectively, elongated square grooves 104, 104' located on the nose bridge 103 and elongated round grooves 105, 105' located on the top and bottom positions of the left and right frame units 101 and 102. Said lens frames 11 and 11' are made of hard polycarbonate resin material, assembled on the left and right frame units 101 and 102, which accommodate the lens 110 and 110', and, corresponding to the three clasp mortises 104 (elongated square groove) 105, 105' (elongated round grooves) are clasp tenons, such as an elongated square tenon 112 to match the elongated square groove 104, and elongated round tenons 113 to match the elongated round grooves 105, 105'.

Furthermore, on the left/right frame units 101 and 102 and away from the nose bridge 103 is the installation of an assembling device 2. Said assembling device 2 includes an assembling hole 20 located on the left/right frame units 101 and 102. A check unit 21 located on the lens frames 11 and 11' matching said assembling hole 2, and a joining unit 22 pulling through the assembling hole 20 to be engaged to the check unit 21. On the joining unit 22 is a positioning groove 23 to fix the headband of the swimming goggles. This construction is characterized by more solid assembly of the main frame unit with the left and right frame unit. The assembling hole 20 on the left/right frame unit 101 and 102 is an opening facing obliquely from outside toward the inside. The check unit 21 forms a clasp jut with the lens frames 11 and 11'. The joining unit 22 involves a first clasp arm 221 and a second clasp arm 222 formed on one side of a plate body to catch the clasp jut (check unit 21), and on the plate surface are several positioning grooves 23 to fasten the headband device 3.

Figure 3:
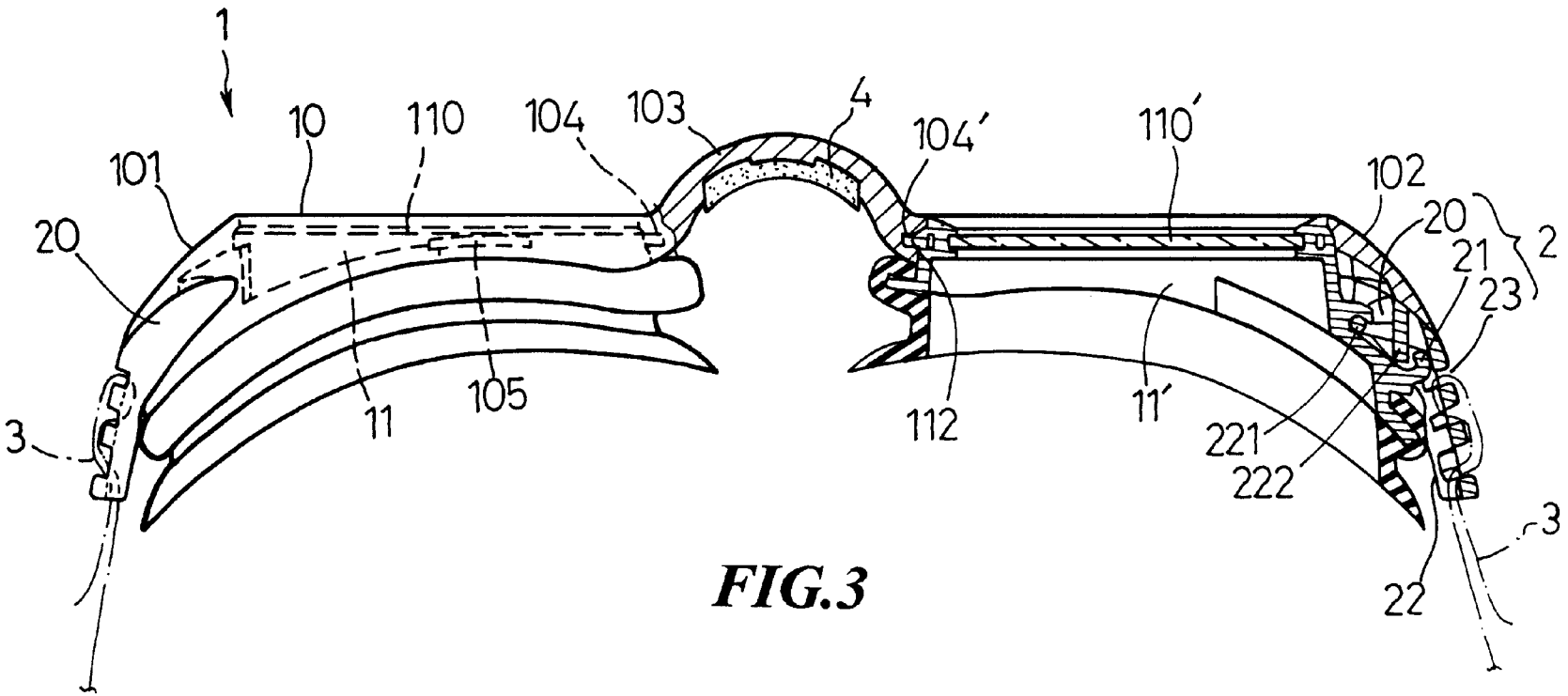
FIG. 3 is a sectional assembled view of the subject swimming goggle invention.
Figure 4:
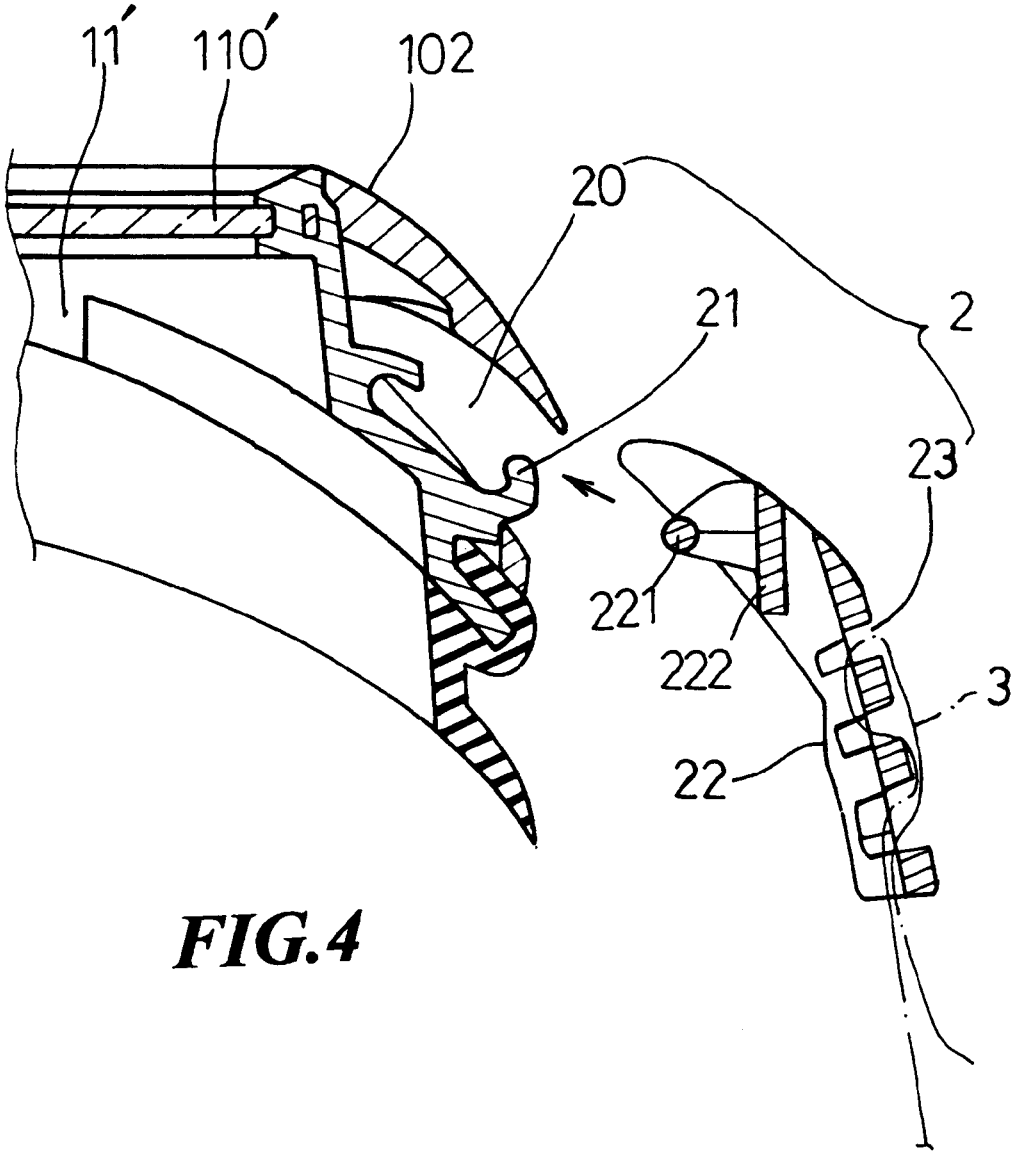
FIGS. 4 and 5 illustrate how the subject swimming goggle invention is assembled.
Figure 5:
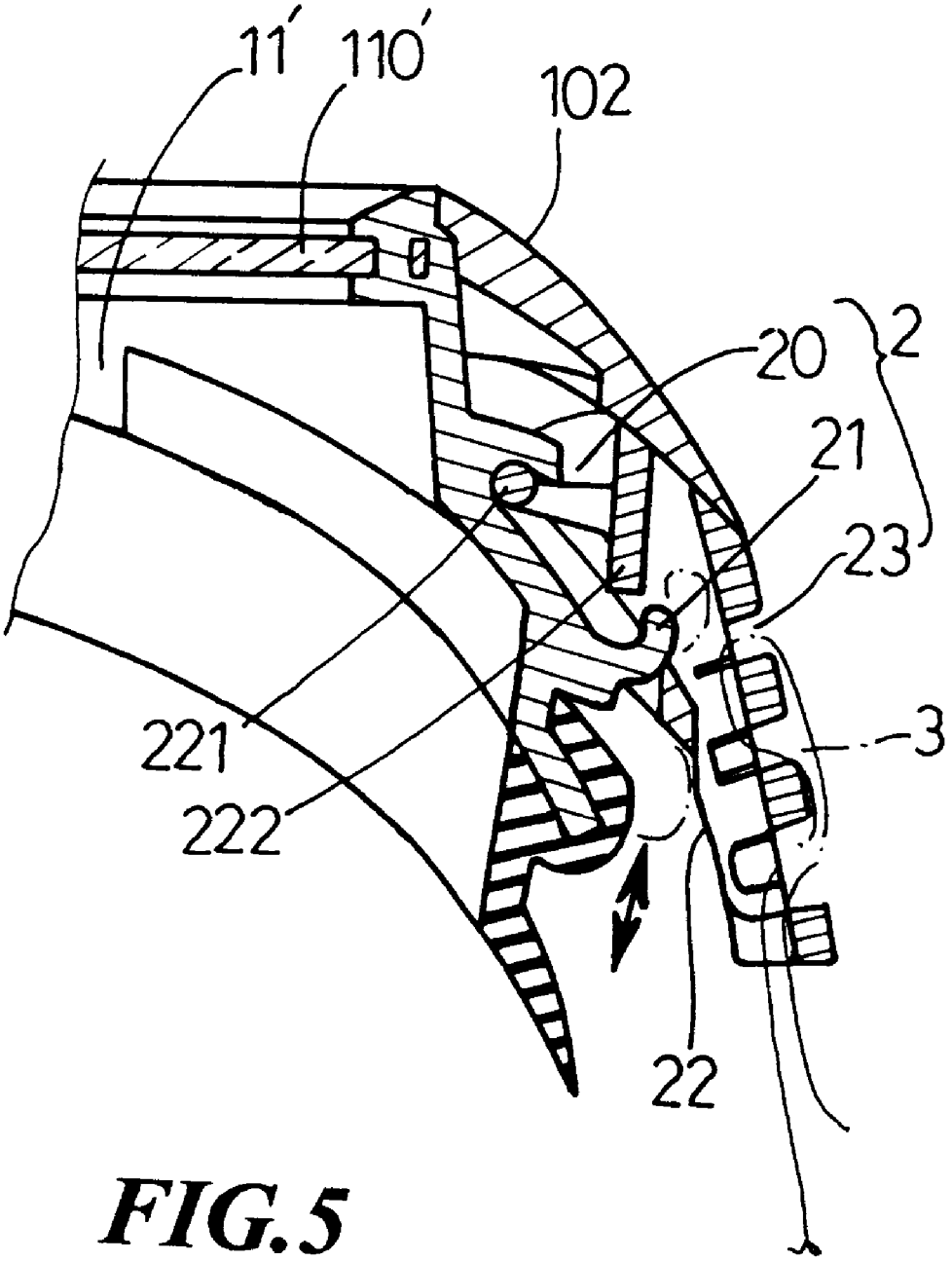

Please refer to FIGS. 3, 4 and 5, which illustrate how one side of the lens frame is assembled. As shown in the drawing, firstly, the lens frame 11 is slightly inclined, so that its elongated square tenon can be clasped inside the elongated square groove 104 of the frame unit 101. The lens frame 11 is depressed so the elongated round tenon 113 is fastened with the elongated round groove 105, now the lens frame 11 is primarily set in place. Secondly, the assembling device 2 is inclined and inserted into the assembling hole 20, so the first clasp arm 221 is in contact with one end of the clasp jut (check unit 21), which is further depressed so that the second clasp arm 222 is linked to the other end of the clasp jut (check unit 21), thus the assembling device 2 is depressed and secured with the lens frame 11. One point worth mentioning is that, the installation of the plate-shaped assembling device 2 serves to complement the assembling hole 20 with an opening, so the appearance of the swimming goggles can be enhanced. The assembling device 2 provides additional positioning effect to the headband device 3.

The above description has proved that the subject invention is able to achieve its objective to satisfy the requirements for a patent right. However, the above description covers merely a preferred embodiment of the subject invention. All equivalent modifications and variations deriving from the above description shall be included in the intent and spirit of the subject claims.

What is claimed is:

1. Swimming goggles comprising:

a binding frame comprising left and right frame units, left and right lens frames, a nose bridge that connects said left and right frame units, left and right assembling devices, and a headband device; wherein said left and right frame units each receive a lens frame, and each said lens frame receives a lens, said left and right frame units of said binding frame each comprise at least one clasp unit and one check unit, each said lens frame comprises at least one clasp device corresponding in position to said clasp unit on said left and right frame units, and each said assembling device is received in a corresponding assembling hole on said left and right frame units; such that said clasp units engage said check units through said assembling devices, such that said left and right lens frames are securely fastened in said left and right frame units of said binding frame.

2. The swimming goggles as recited in claim 1, wherein:

each said assembling hole comprises an open groove in said left and right frame units, each said check unit comprises a clasp tenon on a corresponding one of said lens frames, said clasp unit comprises a first clasp arm and a second clasp arm that are formed on one side of a plate body so as to engage said clasp tenon, and a surface of said plate body comprises a plurality of positioning grooves to receive said headband device.

3. The swimming goggles as recited in claim 2, wherein:

said binding frame is made of flexible material, and said left and right lens frames are made of hard polycarbonate resin material.

4. The swimming goggles as recited in claim 3, wherein:

an inner side of said nose bridge is lined with foam sponge to provide wearing comfort.

5. The swimming goggles as recited in claim 4, wherein:

said left and right frame units comprise three of said clasp units arranged in a triangle.

6. The swimming goggles as recited in claim 5, wherein:

a first one of said clasp units is located near said nose bridge and comprises an elongated square groove, and said left and right frame units each comprise an elongated square tenon that is received in said elongated square groove, and wherein:

at least a second one of said clasp units is an elongated round groove, and said left and right frame units each comprise at least one corresponding elongated round tenon that is received in said elongated round groove.

7. The swimming goggles as recited in claim 6, wherein:

said goggles further provide a protective pad on an inner side of said lens frames to provide a more secure fit to a user's face.

* * * * *